US012440883B2

(12) United States Patent
Mitsunobu et al.

(10) Patent No.: US 12,440,883 B2
(45) Date of Patent: Oct. 14, 2025

(54) HOT STAMPED MEMBER

(71) Applicant: NIPPON STEEL CORPORATION, Tokyo (JP)

(72) Inventors: Takuya Mitsunobu, Tokyo (JP); Hiroshi Takebayashi, Tokyo (JP); Takehiro Takahashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 297 days.

(21) Appl. No.: 18/252,541

(22) PCT Filed: Jan. 14, 2022

(86) PCT No.: PCT/JP2022/001102
§ 371 (c)(1),
(2) Date: May 11, 2023

(87) PCT Pub. No.: WO2022/154081
PCT Pub. Date: Jul. 21, 2022

(65) Prior Publication Data

US 2024/0001423 A1 Jan. 4, 2024

(30) Foreign Application Priority Data

Jan. 14, 2021 (JP) ..... 2021-004022

(51) Int. Cl.
*B32B 15/04* (2006.01)
*B21D 22/02* (2006.01)
(Continued)

(52) U.S. Cl.
CPC ..... *B21D 22/022* (2013.01); *C22C 30/06* (2013.01); *C22C 38/002* (2013.01); *C22C 38/02* (2013.01); *C23C 2/04* (2013.01)

(58) Field of Classification Search
CPC ..... B32B 15/012; C23C 28/345
(Continued)

(56) References Cited

U.S. PATENT DOCUMENTS 6,635,359 B1 * 10/2003 Kurosaki ..... C23C 2/26 428/653
10,287,647 B2 * 5/2019 Köyer ..... C22C 38/02
(Continued)

FOREIGN PATENT DOCUMENTS

| | | | |
|---|---|---|---|
| EP | 4230760 | A1 | 8/2023 |
| WO | 2017/017513 | A1 | 2/2017 |
| WO | 2017/017514 | A1 | 2/2017 |

OTHER PUBLICATIONS

European Search Report corresponding to counterpart European Patent Application EP22739486.3 mailed Dec. 17, 2024.

*Primary Examiner* — Lauren R Colgan
(74) *Attorney, Agent, or Firm* — Renner, Otto, Boisselle & Sklar, LLP

(57) ABSTRACT

This hot stamped member includes: a steel; and a plating layer formed on the steel, in which the plating layer has a predetermined chemical composition, the plating layer contains a Zn-based oxide including one or two of a Zn oxide and a Zn—Mg oxide having a size of 1.0 μm or more and 10.0 μm or less in a thickness direction of the plating layer and 0.1 μm or more in a direction perpendicular to the thickness direction, and in a cross section of the plating layer in the thickness direction, when a length of an interface between the plating layer and the steel is indicated as Le, a sum of lengths of the Zn-based oxide projected onto the interface from an upper surface of the plating layer is indicated as ΣLi, and a sum of lengths of portions of the Zn-based oxide in contact with the plating layer projected
(Continued)

onto the interface from the upper surface of the plating layer is indicated as ΣLai, ΣLi/Le≥0.10 and ΣLai/ΣLi≥0.50 are satisfied.

3 Claims, 1 Drawing Sheet

(51) Int. Cl.

| | |
|---|---|
| ***B32B 17/06*** | (2006.01) |
| ***C22C 30/06*** | (2006.01) |
| ***C22C 38/00*** | (2006.01) |
| ***C22C 38/02*** | (2006.01) |
| ***C23C 2/04*** | (2006.01) |

(58) Field of Classification Search
USPC ..... 428/701
See application file for complete search history.

(56) References Cited

U.S. PATENT DOCUMENTS 11,338,550 B2 * 5/2022 Tokuda ..... C23C 28/025
11,939,651 B2 * 3/2024 Kim ..... C21D 8/0226
12,012,655 B2 * 6/2024 Allely ..... B32B 15/01
2003/0003321 A1 * 1/2003 Sugimaru ..... C23C 2/12 427/431
2006/0269776 A1 * 11/2006 Tanaka ..... C23C 2/06 148/533
2006/0292391 A1 * 12/2006 Ikematsu ..... C22C 38/58 427/433
2011/0274945 A1 * 11/2011 Shimoda ..... C23C 2/26 427/398.1
2012/0085466 A1 * 4/2012 Lupp ..... C23C 2/12 148/400
2012/0282488 A1 * 11/2012 Fujii ..... C23C 2/12 427/349
2015/0284861 A1 * 10/2015 Allely ..... C22C 38/58 148/530
2015/0329946 A1 * 11/2015 Yasui ..... C23C 28/345 148/533
2019/0366686 A1 * 12/2019 Fuda ..... C22C 38/04
2021/0008837 A1 * 1/2021 Hwang ..... C22C 38/02
2021/0039354 A1 * 2/2021 Tokuda ..... C23C 28/345
2021/0039355 A1 * 2/2021 Mitsunobu ..... B32B 15/20
2021/0348257 A1 * 11/2021 Lee ..... C23C 28/021
2023/0407448 A1 * 12/2023 Mitsunobu ..... C21D 1/74

* cited by examiner

HOT STAMPED MEMBER

TECHNICAL FIELD OF THE INVENTION

The present invention relates to a hot stamped member.

Priority is claimed on Japanese Patent Application No. 2021-004022, filed Jan. 14, 2021, the content of which is incorporated herein by reference.

RELATED ART

In recent years, there has been a demand for curbing the consumption of chemical fuels in order to protect the environment and prevent global warming. To such a demand, for example, vehicles, which are indispensable for daily life and activities as movement units, are no exception. In response to such a demand, in vehicles, an improvement in fuel efficiency or the like by a reduction in weight of a vehicle body or the like is being studied. Since most of structures of vehicles are formed of iron, particularly steel sheets, thinning steel sheets and reducing the weight has a great effect on the reduction in weight of a vehicle body. However, when the steel sheet is simply reduced in thickness to reduce the weight of the steel sheet, there is concern that the strength of a structure decreases and safety decreases. Therefore, in order to reduce the thickness of the steel sheet, it is required to increase a mechanical strength of the steel sheet to be used so as not to reduce the strength of the structure.

Therefore, by increasing the mechanical strength of the steel sheet, research and development are being conducted on a steel sheet that can maintain or increase the mechanical strength even when the steel sheet is made thinner than previously used steel sheets. Such a demand for a steel sheet is applied not only to a vehicle manufacturing industry but also to various manufacturing industries.

In general, a material having high mechanical strength tends to have low shape fixability in a forming process such as bending, and in a case where the material is processed into a complex shape, the processing itself becomes difficult. As one of methods for solving problems of formability, application of a so-called hot stamping method can be mentioned. In the hot stamping method, a material to be formed is once heated to a high temperature to be austenitized, and the material softened by the heating is subjected to press working to be formed, and is rapidly cooled with a die after the forming or simultaneously with the forming to undergo martensitic transformation, so that a product having high strength after the forming can be obtained.

According to the hot stamping method, since the material is once heated to a high temperature to be softened, and the material is subjected to press working in a softened state, the material can be easily subjected to press working. Therefore, by this hot press working, a press-formed article having both good shape fixability and high mechanical strength can be obtained. In particular, in a case where the material is steel, the mechanical strength of the press-formed article can be increased due to a quenching effect by cooling after forming.

However, in a case where the hot stamping method is applied to a steel sheet, heating to a high temperature of, for example, 800° C. to 850° C. or higher causes oxidation of iron or the like on a surface and formation of scale (oxide). Therefore, a step of removing the scale (descaling step) is required after the hot press working is performed, resulting in a reduction in productivity. In addition, for a member or the like that requires corrosion resistance, it is necessary to perform an antirust treatment or a metal coating on a surface of the member after working, so that a surface cleaning step and a surface treatment step are required, which also reduces productivity.

As an example of a method of suppressing such a reduction in productivity, there is a method of coating a steel sheet. In general, as a coating of a steel sheet, various materials such as an organic material and an inorganic material are used. In particular, for steel sheets, a zinc-based plating having a sacrificial protection action has been widely applied from the viewpoint of anticorrosion performance and a steel sheet production technology. On the other hand, regarding a heating temperature at the time of pressing, pressing is often performed at a temperature higher than an Ac3 transformation point of steel in order to obtain a quenching effect, and for example, the heating temperature is about 800° C. to 1000° C. However, this heating temperature is higher than a decomposition temperature of the organic material, a boiling point of a metal material such as a Zn-based material, and the like. Therefore, in a case where a steel sheet coated with an organic material or a Zn-based metal material is heated for hot pressing, a plating layer on a surface of the steel sheet evaporates, which may cause significant deterioration of surface properties.

In order to avoid such deterioration of the surface properties, for a steel sheet that is heated to a high temperature to be subjected to hot press working, for example, the steel sheet is preferably coated with an Al-based metal having a higher boiling point than an organic material coating or a Zn-based metal coating.

By using the steel sheet coated with the Al-based metal, a so-called Al-plated steel sheet, adhesion of scale to a surface of the steel sheet can be prevented, and a step such as a descaling step becomes unnecessary, resulting in an improvement in productivity. In addition, since the Al-based metal coating also has an antirust effect, corrosion resistance after coating is also improved.

Therefore, as a steel sheet for hot stamping, an Al-plated steel sheet having an Al-plated on a surface has begun to be applied.

However, in a case where the Al-plated steel sheet is subjected to a hot stamping, there is a problem that chemical convertibility of a hot stamped member (steel sheet after hot stamping) is not sufficient.

In a case of improving the chemical convertibility of the steel sheet after hot stamping, it has been proposed to include Zn or Mg in a plating layer. However, inclusion of Zn or Mg in the plating layer may cause cracking due to LME when spot welding is performed.

For example, Patent Document 1 discloses a steel sheet coated with a metal coating containing 2.0 to 24.0 wt % of zinc, 7.1 to 12.0 wt % of silicon, optionally 1.1 to 8.0 wt % of magnesium, and optionally additive elements selected from Pb, Ni, Zr, or Hf, in which a weight amount of each of the additive elements is less than 0.3 wt %, a remainder consists of aluminum, optional unavoidable impurities, and residual elements, and an Al/Zn ratio exceeds 2.9.

Patent Document 2 discloses a method of manufacturing a hardened component, which is a method of obtaining a component that does not have a problem of LME caused by hot forming when performing hot forming on a steel sheet coated in advance with a metal coating containing 2.0 to 24.0 wt % of zinc, 1.1 to 7.0 wt % of silicon, optionally 1.1 to 8.0 wt % of magnesium in a case where the amount of silicon is between 1.1 to 4.0 wt %, and optionally additive elements selected from Pb, Ni, Zr, or Hf, in which a weight amount of each of the additive elements is less than 0.3 wt %, a remainder consists of aluminum, unavoidable impurities, and residual elements.

PRIOR ART DOCUMENT

Patent Document

[Patent Document 1] PCT International Publication No. WO2017/017513

[Patent Document 2] PCT International Publication No. WO2017/017514

DISCLOSURE OF THE INVENTION

Problems to be Solved by the Invention

However, in Patent Document 1, no examination was conducted regarding LME.

In addition, in the method of Patent Document 2, although an effect of suppressing LME during hot forming such as hot stamping was recognized, as a result of examination by the present inventors, it was found that in a case where spot welding is performed on a component obtained by this method, LME occurs.

As described above, in a related art, a hot stamped member having excellent chemical convertibility and being capable of suppressing LME during spot welding has not been proposed. Therefore, an object of the present invention is to provide a hot stamped member having excellent chemical convertibility and being capable of suppressing LME during spot welding (having excellent LME resistance) on the premise of a hot stamped member using an Al-plated steel (a steel including a plating layer containing Al) as a material.

Means for Solving the Problem

The present inventors conducted examinations to improve chemical convertibility and LME resistance during spot welding in a hot stamped member obtained by performing hot stamping on an Al-plated steel sheet. As a result, it was found that by limiting a chemical composition of a plating layer and allowing the plating layer to contain a Zn oxide and/or a Zn—Mg oxide having a predetermined size in a predetermined distribution state, excellent chemical convertibility is achieved and LME during spot welding can be suppressed.

The present invention has been made based on the above findings, and the gist thereof is as follows.

[1] A hot stamped member according to an aspect of the present invention includes: a steel; and a plating layer formed on the steel, in which the plating layer contains, as a chemical composition, by mass %, Zn: 0.5% to 15.0%, Mg: 0% to 10.0%, Si: 0.05% to 10.0%, Fe: 20.0% to 60.0%, 0% to 5.00% in total of one or two or more selected from Ca: 0% to 3.00%, Sb: 0% to 0.50%, Pb: 0% to 0.50%, Sr: 0% to 0.50%, Sn: 0% to 1.00%, Cu: 0% to 1.00%, Ti: 0% to 1.00%, Ni: 0% to 1.00%, Mn: 0% to 1.00%, Cr: 0% to 1.00%, La: 0% to 1.00%, Ce: 0% to 1.00%, Zr: 0% to 1.00%, and Hf: 0% to 1.00%, and a remainder of Al and impurities, the plating layer contains a Zn-based oxide including one or two of a Zn oxide and a Zn—Mg oxide having a size of 1.0 μm or more and 10.0 μm or less in a thickness direction of the plating layer and 0.1 μm or more in a direction perpendicular to the thickness direction, and in a cross section of the plating layer in the thickness direction, when a length of an interface between the plating layer and the steel is indicated as Le, a sum of lengths of the Zn-based oxide projected onto the interface from an upper surface of the plating layer is indicated as ΣLi, and a sum of lengths of portions of the Zn-based oxide in contact with the plating layer projected onto the interface from the upper surface of the plating layer is indicated as ΣLai, Expressions (1) and (2) are satisfied.

$$\Sigma Li/Le \geq 0.10 \quad (1)$$

$$\Sigma Lai/\Sigma Li \geq 0.50 \quad (2)$$

[2] In the hot stamped member according to [1], in the chemical composition, by mass %, Mg: 0.2% to 7.0% may be satisfied.

[3] In the hot stamped member according to [1], in the chemical composition, by mass %, Mg: 3.0% to 7.0%, and Zn: 7.0% to 15.0% may be satisfied.

Effects of the Invention

According to the above aspect of the present invention, it is possible to provide a hot stamped member having excellent chemical convertibility and excellent LME resistance during spot welding.

EMBODIMENTS OF THE INVENTION

A hot stamped member according to an embodiment of the present invention (a hot stamped member according to the present embodiment) will be described.

Figure 1:
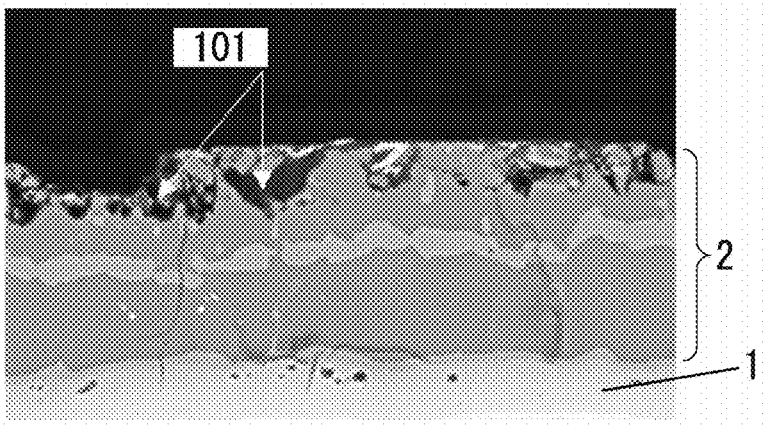
FIG. 1 is a view showing an example of a cross section of a plating layer of a hot stamped member according to the present embodiment.

As shown in FIG. 1, the hot stamped member according to the present embodiment includes a steel 1 and a plating layer 2 formed on the steel 1, in which the plating layer 2 has a predetermined chemical composition, the plating layer 2 contains a Zn-based oxide 101 (including one or two of a Zn oxide and a Zn—Mg oxide) having a size of 1.0 μm or more and 10.0 μm or less in a thickness direction of the plating layer 2 and 0.1 μm or more in a direction perpendicular to the thickness direction, and in a cross section of the plating layer 2 in the thickness direction, when a length of an interface between the plating layer 2 and the steel 1 is indicated as Le and a sum of lengths of the Zn-based oxide 101 projected onto the interface between the plating layer 2 and the steel 1 from an upper surface of the plating layer 2 is indicated as ΣLi, ΣLi/Le≥0.10 (ΣLi/Le is 0.10 or more) is satisfied, and when a sum of lengths of portions of the Zn-based oxide 101 in contact with the plating layer projected onto the interface between the plating layer 2 and the steel 1 from the upper surface of the plating layer 2 is indicated as ΣLai, ΣLai/ΣLi≥0.50 is satisfied. Since the Zn-based oxide is mainly formed by hot stamping, the Zn-based oxide is mainly formed in the vicinity of a surface layer area as shown in FIG. 1.

<Steel>

The plating layer 2 is important for the hot stamped member according to the present embodiment, and the kind of the steel 1 is not particularly limited. The kind of the steel 1 may be determined depending on an applicable product, a required strength, a sheet thickness, and the like. For example, a steel sheet such as a hot-rolled steel sheet described in JIS G 3131:2018 or a cold-rolled steel sheet described in JIS G 3141:2017 can be used.

<Plating Layer>

The hot stamped member according to the present embodiment has the plating layer 2 on (a surface of) the steel 1. The plating layer 2 may be formed on one surface of the steel 1 or may be formed on both surfaces.

[Chemical Composition]

Regarding the chemical composition of the plating layer 2 included in the hot stamped member according to the present embodiment, the reason for limiting each element included will be described. % of the amount of each element is mass %.

Zn: 0.5% to 15.0%

Zn is an element that forms a Zn-based oxide (a Zn oxide or, in a case where the plating layer contains Mg, also a Zn—Mg oxide) on the surface of the steel by hot stamping. In a case where the Zn oxide is present on a surface of the hot stamped member, chemical convertibility is improved. In addition, Zn is also an element that contributes to an improvement in corrosion resistance of the plating layer by an improvement in sacrificial protection properties. In order to obtain these effects, a Zn content is set to 0.5% or more. The Zn content is preferably 1.0% or more, more preferably 5.0% or more, and even more preferably 7.0% or more.

On the other hand, when the Zn content exceeds 15.0%, it becomes difficult to suppress LME. Therefore, the Zn content is set to 15.0% or less. The Zn content is preferably 10.0% or less.

Mg: 0% to 10.0%

Mg is an element having an effect of forming a Zn—Mg oxide together with Zn on the surface of the steel during hot stamping and enhancing the chemical convertibility of the hot stamped member. In terms of improving the chemical convertibility, the Zn—Mg oxide has a greater effect than the Zn oxide. Mg does not necessarily need to be contained, but may be contained in order to obtain the above-mentioned effects. In a case of sufficiently obtaining the above effects, a Mg content is preferably set to 0.2% or more. The Mg content is more preferably 0.5% or more, and even more preferably 2.0% or more.

On the other hand, in order to cause the Mg content of the hot stamped member to exceed 10.0%, the Mg content of a plated steel sheet needs to exceed 15.0%. In this case, there arises a manufacturing problem, such as an increase in the amount of dross generated in a plating bath. Therefore, the Mg content is set to 10.0% or less. The Mg content is preferably 7.0% or less, and more preferably 5.0% or less.

Si: 0.05% to 10.0%

Si is an element having an effect of suppressing the formation of an excessively thick alloy layer formed between the steel sheet and the plating layer in forming the plating layer on the steel sheet and enhancing the adhesion between the steel sheet and the plating layer. In addition, in a case where Si is included together with Mg, Si is also an element that forms a compound with Mg and contributes to an improvement in corrosion resistance after coating. In a case of obtaining the above effects, a Si content is set to 0.05% or more. The Si content is preferably 0.1% or more, and more preferably 1.0% or more.

On the other hand, when the Si content exceeds 10.0%, workability of the plating layer decreases. Therefore, the Si content is set to 10.0% or less. The Si content is preferably 8.0% or less.

Fe: 20.0% to 60.0%

Fe diffuses from the steel to the plating layer at the time of forming the plating layer and diffuses from the steel to the plating layer at the time of hot stamping, thereby being included in the plating layer. A portion of Fe is bonded to Al or the like in the plating layer to form an alloy.

When an Fe content is less than 20.0%, an unalloyed Al phase remains in the plating layer. In this case, the plating layer may adhere to a die and manufacturability may decrease.

On the other hand, when the Fe content exceeds 60.0%, an Fe concentration is excessive, and red rust may be formed at an early stage in a corrosive environment.

0% to 5.00% in Total of One or Two or More Selected from Ca: 0% to 3.00%, Sb: 0% to 0.50%, Pb: 0% to 0.50%, Sr: 0% to 0.50%, Sn: 0% to 1.00%, Cu: 0% to 1.00%, Ti: 0% to 1.00%, Ni: 0% to 1.00%, Mn: 0% to 1.00%, Cr: 0% to 1.00%, La: 0% to 1.00%, Ce: 0% to 1.00%, Zr: 0% to 1.00%, and Hf: 0% to 1.00%

The plating layer of the hot stamped member according to the present embodiment includes one or two or more of Ca, Sb, Pb, Sr, Sn, Cu, Ti, Ni, Mn, Cr, La, Ce, Zr, and Hf as impurities or by intentional addition within the above ranges.

When a Ca content is high, Ca-based intermetallic compounds such as a $CaZn_{11}$ phase are formed in the plating layer, and the corrosion resistance decreases. Therefore, the Ca content is set to 3.00% or less.

On the other hand, when Ca is contained in the plating layer, the amount of dross that is likely to be formed during plating as the Mg content increases, decreases, so that plating manufacturability is improved. Therefore, Ca may be contained in a range of 3.00% or less.

When a Sb content, a Sr content, or a Pb content are excessive, a viscosity of the plating bath increases, and it is often difficult to build the plating bath itself. In this case, a plated steel sheet having good plating properties cannot be manufactured. Therefore, the Sr content is set to 0.50% or less, the Sb content is set to 0.50% or less, and the Pb content is set to 0.50% or less.

When Sr, Sb, or Pb are contained in the plating layer, an external appearance of the plating layer changes, spangles are formed, and an improvement in metallic gloss is confirmed. Therefore, each of these elements may be contained in a range of 0.50% or less.

Sn is an element that increases a Mg elution rate in the plating layer containing Zn, Al, and Mg. When the elution rate of Mg increases, the corrosion resistance of a flat portion deteriorates. Therefore, a Sn content is set to 1.00% or less.

When a Cu content, a Ti content, a Ni content, or a Mn content are excessive, the viscosity of the plating bath increases, and it is often difficult to build the plating bath itself. In this case, a plated steel sheet having good plating properties cannot be manufactured. Therefore, the amount of each element is set to 1.00% or less.

On the other hand, these elements are elements that contribute to the improvement in corrosion resistance. Therefore, these elements may be contained in a range of 1.00% or less.

When a La content or a Ce content are excessive, the viscosity of the plating bath increases, and it is often difficult to build the plating bath itself. In this case, a plated steel having good plating properties cannot be manufactured. Therefore, each of the La content and the Ce content is set to 1.00% or less.

When a Zr content or a Hf content are excessive, the corrosion resistance may decrease. Therefore, the Zr content and the Hf content are each set to 1.00% or less.

The chemical composition of the plating layer of the plated steel sheet according to the present embodiment has the above-mentioned chemical composition, and a remainder of Al and impurities.

The chemical composition of the plating layer is measured by the following method.

First, an acid solution is obtained by peeling and dissolving the plating layer with an acid containing an inhibitor that suppresses corrosion of the base metal (steel). Next, the chemical composition of the plating layer can be obtained by measuring the obtained acid solution by an ICP analysis. The kind of the acid is not particularly limited as long as the acid is an acid capable of dissolving the plating layer. The chemical composition is measured as an average chemical composition.

Since O cannot be analyzed in the ICP analysis, the above chemical composition is the amount of an element that does not consider the presence of O in the plating layer.

[Microstructure]

The plating layer included in the hot stamped member according to the present embodiment contains the Zn-based oxide including one or two of the Zn oxide and the Zn—Mg oxide having a size of 1.0 μm or more and 10.0 μm or less in the thickness direction of the plating layer and 0.1 μm or more in the direction (surface direction) perpendicular to the thickness direction.

In addition, in the cross section of the plating layer in the thickness direction, when the length of the interface between the plating layer and the steel is indicated as Le, a sum of lengths of the Zn-based oxide having the above size projected onto the interface from the upper surface of the plating layer is indicated as ΣLi, and a sum of lengths of portions of the Zn-based oxide in contact with the plating layer projected onto the interface between the plating layer and the steel from the upper surface of the plating layer is indicated as ΣLai, $\Sigma Li/Le \geq 0.10$ and $\Sigma Lai/\Sigma Li \geq 0.50$ are satisfied.

When the Zn-based oxide including one or two of the Zn oxide and the Zn—Mg oxide is present in the plating layer, zinc phosphate crystals (in a case of Zn—Mg, zinc phosphate crystal containing Mg) are formed into a film when a chemical conversion treatment is performed. As a result, excellent chemical convertibility can be obtained.

However, in a case where a projected length when the Zn-based oxide (Zn oxide or Zn—Mg oxide) having a predetermined size is projected onto the interface is smaller than the length of the interface between the plating layer and the steel (the interface is not sufficiently covered when viewed from the upper surface), the effect of improving the chemical convertibility is not sufficiently obtained. Therefore, when viewed in the cross section in the thickness direction, a ratio of a sum of projected lengths of the Zn-based oxide having a size of 1.0 μm or more and 10.0 μm or less in the thickness direction and 0.1 μm or more in the surface direction (in other words, a sum of lengths of the interface having an oxide upward thereof) to the length of the interface is set to 0.10 (10%) or more. The ratio is preferably 0.30 (30%) or more, and more preferably 0.50 (50%) or more.

In addition, in a case where the Zn-based oxide including one or two of the Zn oxide and the Zn—Mg oxide having a size of 1.0 μm or more and 10.0 μm or less in the thickness direction of the plating layer and 0.1 μm or more in the direction perpendicular to the thickness direction is not included, chemical convertibility decreases.

In addition, even if the Zn-based oxide is included in the plating layer, when a gap (cavity) is present between the plating layer and the Zn-based oxide, after a chemical conversion treatment, the gap remains between a chemical conversion layer and the plating layer. In this case, adhesion of the chemical conversion layer decreases, and lack of hiding is likely to occur.

Therefore, in the plating layer included in the hot stamped member according to the present embodiment, the ratio of the portions of the oxide in contact with the plating layer is increased. Specifically, the ratio of the portions of the oxide in contact with the plating layer is calculated as follows.

First, in the cross section of the plating layer in the thickness direction, the length of the entire interface between the plating layer and the steel is indicated as Le, and the sum of the lengths of the Zn-based oxide projected onto the interface from the upper surface of the plating layer is indicated as ΣLi. In addition, the sum of the lengths of the portions of the oxide in contact with the plating layer projected onto the interface in a direction from the upper surface of the plating layer is indicated as ΣLai. Therefore, when the ratio of the portions of the oxide in contact with the plating layer is increased, the ratio of ΣLai to ΣLi is increased.

The "portions of the oxide in contact with the plating layer" are defined as portions excluding portions that are "not in contact with the plating layer" from the entire oxide. The portions of the oxide that are not in contact with the plating layer are defined as portions where a gap (cavity) of more than 0.5 mm is present between the plating layer and the Zn-based oxide in a SEM observation of the cross section. On the other hand, in the SEM observation of the cross section, when no gap is observed between the plating layer and the Zn-based oxide, or an observed gap is 0.5 mm or less, this is defined as the portion of the oxide in contact with the plating layer.

In addition, regarding the portion of the oxide in contact with the plating layer, in a case where the plating layer is present on both sides of the oxide in the thickness direction, it means that a gap is 0.5 mm or less (including 0) between the plating layer and the oxide on both sides in the thickness direction in the portion. In a case where the plating layer is present on only one side of the oxide in the thickness direction (for example, in a case where the oxide is an outermost layer), it means that a gap is 0.5 mm or less from the plating layer in a direction in which the plating layer is present in the portion. That is, even if the oxide is present, a portion where the plating layer is present with a gap of more than 0.5 mm from the oxide in the thickness direction, the portion is excluded from an object to measure the projected length when obtaining ΣLai.

It is considered that such a gap between the plating layer and the oxide is caused by evaporation of Zn.

In the hot stamped member according to the present embodiment, as will be described later, a Zn phase in dendrites is dispersed and diffusion of oxygen into the plating layer is promoted, whereby such elements can be fixed as oxides before Zn (in the case where Mg is contained, also Mg) evaporate. In this case, by suppressing the formation of the gap, ΣLai/ΣLi can be set to 0.50 (50%) or more.

ΣLai/ΣLi is preferably 0.60 or more, more preferably 0.70 or more, and even more preferably 0.80 or more.

The presence of the Zn-based oxide (the Zn oxide and/or the Zn—Mg oxide) having a size of 1.0 μm or more and 10.0 μm or less in the thickness direction of the plating layer and 0.1 μm or more in the direction perpendicular to the thickness direction can be confirmed by the following method.

A sample is collected so that the cross section of the plating layer including the interface between the steel and the plating layer can be observed, and the cross section of the plated steel sheet is polished in a state embedded in a resin. After polishing to a mirror finish, an element map image is photographed using SEM-EDS by observation with a scanning electron microscope (SEM) in a visual field of, for example, 50 μm×50 μm. In the obtained element map image, a region where O (oxygen) and Zn coexist is determined as a Zn oxide, and a region where O, Zn, and Mg coexist is determined as a Zn—Mg oxide. By measuring dimensions of the Zn oxide and the Zn—Mg oxide specified by this method, the Zn-based oxide (the Zn oxide and/or the Zn—Mg oxide) having a size of 1.0 μm or more and 10.0 μm or less in the thickness direction of the plating layer and 0.1 μm or more in the direction perpendicular to the thickness direction can be specified.

In addition, the ratio (ΣLi/Le) of the sum of the projected lengths to the length of the interface is obtained by the following method.

Figure 2:
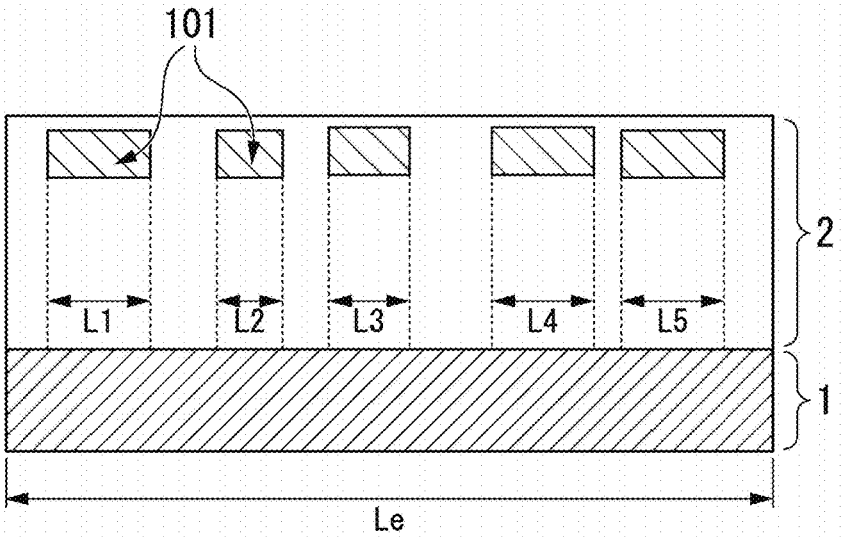
FIG. 2 is a view describing a method for measuring a ratio of projected lengths of a Zn-based oxide to an interface length.

The Zn-based oxide is identified by the above-described method. Then, for example, as shown in FIG. 2, in a case where a plurality of portions of the Zn-based oxide are present in the plating layer 2, respective lengths (L1, L2, L3, L4, and L5 (L1 to L5 in the figure, but in a case where i inclusions are present, L1 to Li)) of the portions of the Zn-based oxide projected onto the interface from the upper surface of the plating layer 2 with respect to the length Le of the interface between the steel 1 and the plating layer 2 in a measurement region are measured. A sum (ΣL5) of L1 to L5 (ΣLi in the case of L1 to Li) is regarded as a sum of the projected lengths. However, portions where projected portions overlap are subtracted from the sum of the lengths (the overlapping portion is included in the length only once).

The ratio (ΣLi/Le) of the sum of the projected lengths to the length of the interface is obtained by dividing the sum (ΣLi) of the projected lengths by the interface length (Le).

On the other hand, the ratio (ΣLai/ΣLi) of the projected lengths of the portions of the oxide in contact with the plating layer to the projected lengths of the oxide is obtained by the following method.

Figure 3:
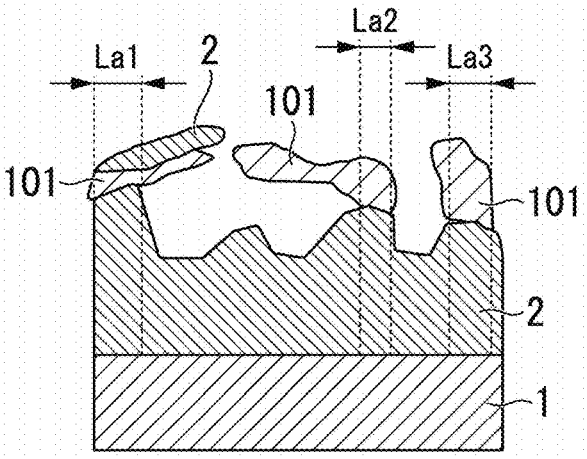
FIG. 3 is a view describing a method of measuring ΣLai.

For example, as shown in FIG. 3, in a case where a plurality of portions of the Zn-based oxide 101 are present in the plating layer 2, when the plating layer is present on both sides of the oxide in the thickness direction (an up-down direction in the figure), projected lengths (for example, La1) of portions with no observed gap from the plating layer on both sides or of portions having an observed gap of 0.5 mm or less (in contact with the plating layer on both sides) are obtained. In addition, in a case where the plating layer is present on only one side of the oxide in the thickness direction, projected lengths (for example, La2 and La3) of portions with no observed gap from the plating layer in the direction or of portions having an observed gap of 0.5 mm or less (in contact with the plating layer) are obtained.

The value of the sum of La1, La2, La3, . . . , Lai is indicated as ΣLai. However, portions where projected portions overlap are subtracted from the sum of the lengths (the overlapping portion is included in the length only once).

ΣLai/ΣLi is calculated from ΣLai and ΣLi obtained by the above methods.

In addition, the microstructure of the plating layer 2 of the hot stamped member according to the present embodiment preferably contains an Fe—Al-based intermetallic compound, an Fe—Al—Si-based intermetallic compound, or an Fe—Zn-based intermetallic compound.

In particular, in the hot stamped member according to the present embodiment, it is preferable that the plating layer contains an $Fe_2Al_5$ phase and the amount of solute Zn in the $Fe_2Al_5$ phase is 3.00 to 8.00 mass %. In this case, the corrosion resistance is improved.

A Mg-based IMC (intermetallic compound phase) is preferably 5 area % or less from the viewpoint of avoiding LME cracking during hot stamping.

In the present embodiment, an area ratio of each phase in the plating layer is obtained by the following method.

First, a prepared sample is cut into a size of 25 mm×25 mm, is embedded in a resin, and is then polished to a mirror finish. Thereafter, a SEM-EDS element map image is obtained from a cross section of the plating layer at a magnification of 1500-fold. The element map image is taken so that the entire thickness of the hot-dip plating layer is included in a visual field. Photographing positions are randomly selected. The photographing positions should not be reselected according to a calculation result of the area ratio.

Each microstructure and each phase are specified from the element map image. Then, by a computer image analysis, total cross-sectional areas of each microstructure and each phase appearing in the cross-sectional photograph of the entirety are measured, and this is divided by a cross-sectional area of the hot-dip plating layer appearing in the cross-sectional photograph of the entirety, whereby the area ratios of each microstructure and each phase are calculated.

<Manufacturing Method>

Next, a preferred manufacturing method of the hot stamped member according to the present embodiment will be described. The effects of the hot stamped member according to the present embodiment can be obtained as long as the hot stamped member has the above-described characteristics regardless of the manufacturing method. However, a method including the following steps is preferable because stable manufacturing can be achieved, the method including:

(I) a plating step of immersing a steel in a plating bath to obtain a plated base sheet;

(II) a cooling step of cooling the plated base sheet to a temperature range of 200° C. or lower;

(III) a holding step of reheating the plated base sheet after the cooling step, as necessary, and holding the plated base sheet in a temperature range of 100° C. to 200° C. for 100 seconds or longer to obtain a plated steel; and (IV) a hot stamping step of performing hot stamping on the plated steel to obtain a hot stamped member.

In the preferred manufacturing method of a hot stamped member according to the present embodiment, according to (I) to (III), it is possible to obtain a plated steel that includes a plating layer having a predetermined chemical composition, in which a microstructure of the plating layer contains an α phase which is a solid solution of Al and Zn, and the α phase contains a Zn phase having a grain size of 10 to 200 nm in a number density of 10/100 $\mu m^2$ or more. By performing hot stamping on this plated steel, the hot stamped member according to the present embodiment can be obtained.

[Plating Step]

In the plating step, a steel is immersed in a plating bath to form a plating layer on a surface of the steel to obtain a plated base sheet.

A composition of the plating layer to be formed can be assumed from a composition of the plating bath, so that the composition of the plating bath may be adjusted according to the desired chemical composition of the plating layer.

The steel provided for the plating step is not particularly limited, and for example, a hot-rolled steel sheet described in JIS G 3131:2018 or a cold-rolled steel sheet described in JIS G 3141:2017 can be used.

In addition, reduction annealing may be performed on the steel prior to the plating step. As annealing conditions, known conditions may be used. For example, the steel may be heated to 750° C. to 900° C. in a 5% $H_2$—$N_2$ gas atmosphere having a dew point of −10° C. or higher and be held for 30 to 240 seconds.

The composition of the plating bath preferably includes, by mass %, Zn: 1.0% to 30.0%, Mg: 0% to 10.0%, Si: 0.05% to 10.0%, Fe: 0% to 10.0%, 0% to 5.00% in total of one or two or more selected from Ca: 0% to 3.00%, Sb: 0% to 0.50%, Pb: 0% to 0.50%, Sr: 0% to 0.50%, Sn: 0% to 1.00%, Cu: 0% to 1.00%, Ti: 0% to 1.00%, Ni: 0% to 1.00%, Mn: 0% to 1.00%, Cr: 0% to 1.00%, La: 0% to 1.00%, Ce: 0% to 1.00%, Zr: 0% to 1.00%, and Hf: 0% to 1.00%, and a remainder of Al and impurities.

By immersing the steel in the plating bath, the plated base sheet provided with a plating layer having a chemical composition similar to that of the plating bath can be obtained. Since the amounts of Zn, Mg, and Fe change due to heating during the hot stamping, in consideration of this change, the chemical composition of the plated base sheet is preferably controlled in order to control the chemical composition of the hot stamped member as described above.

[Cooling Step]

In the cooling step, the plated base sheet after the plating step (pulled up from the plating bath) is cooled after adjusting a plating adhesion amount with a wiping gas such as $N_2$.

During the cooling, after pulling up from the plating bath, cooling (first cooling) is performed so that an average cooling rate down to 380° C. is 20° C./s or faster and slower than 40° C./s, and thereafter cooling to 200° C. or lower (second cooling) is performed so that the average cooling rate between 380° C. and 200° C. is 40° C./s or faster.

By setting the average cooling rate (of the first cooling) down to 380° C. to 20° C./s or faster and slower than 40° C./s, Zn is solid-solubilized in an α phase. Accordingly, in the subsequent holding step, the formation of a Zn phase having a size of 10 to 200 nm in the α phase is promoted. After pulling up from the plating bath, when the average cooling rate down to 380° C. is 40° C./s or faster, Zn cannot be sufficiently solid-solubilized. On the other hand, when the average cooling rate is slower than 20° C./s, Zn is precipitated at a high temperature, and a fine Zn phase cannot be precipitated in the α phase in the subsequent holding step.

By the cooling to 200° C. or lower (second cooling) in which the average cooling rate in a temperature range of 380° C. to 200° C. is limited, the solid-solubilized Zn phase is cooled to a temperature range of 200° C. or lower in a state of being in a supersaturated state. Accordingly, the formation of the Zn phase having a size of 10 to 200 nm in the α phase is promoted in the subsequent holding step.

When the average cooling rate in this temperature range is slower than 40° C./s, the precipitation of the fine Zn phase in the α phase is insufficient at a stage of the plated steel, and the formation of the Zn-based oxide in the hot stamped member is insufficient. The average cooling rate of the second cooling is preferably 60° C./s or faster, more preferably 70° C./s or faster, and even more preferably 80° C./s or faster.

A cooling start temperature (a temperature for switching from the first cooling to the second cooling) for cooling to 380° C. to 200° C. is preferably close to 380° C., but may be between 300° C. and 380° C. as long as the average cooling rate down to 200° C. is 40° C./s or faster.

[Holding Step]

In the holding step, the plated base sheet after the cooling step is held in a temperature range of 100° C. to 200° C. for 100 seconds or longer to obtain a plated steel. During the holding, reheating may be performed as necessary, such as in a case where cooling to 100° C. or lower is performed in the cooling step.

After the above cooling, by performing holding in a temperature range of 100° C. to 200° C. for 100 seconds or longer, the Zn phase having a grain size of 10 to 200 nm is sufficiently precipitated in the α phase. In this case, the Zn-based oxide is sufficiently formed in the hot stamped member.

In a case where a holding temperature is low or a retention time is short, the amount of the Zn phase precipitated is insufficient, and the formation of the Zn-based oxide in the hot stamped member is insufficient.

On the other hand, in a case where the holding temperature is high, it becomes difficult to form the Zn phase having a size of 10 to 200 nm in the α phase. In addition, since a long retention time causes the Zn phase to grow coarsely, the retention time is set to 1000 seconds or shorter.

In addition, the holding step is preferably performed within 5 minutes after the cooling step (the first cooling and the second cooling) is completed. "The cooling step is completed" is a time when the temperature of the steel reaches 200° C.

When the time from the completion of the cooling step to the start of the holding step exceeds 5 minutes, precipitation of an $\alpha_R$ phase, which is a metastable phase, starts, and it becomes difficult to satisfy the number density of the Zn phase in the α phase.

The time from the completion of the cooling step to the start of the holding step is preferably within 1 minute.

[Hot Stamping Step]

In the hot stamping step, the plated steel sheet obtained through the above steps is heated and cooled together with or after forming.

In the hot stamping step, in order to apply a predetermined strength to the steel sheet, the steel sheet is heated to, for example, 840° C. to 1000° C., is held for 1 to 4 minutes, and is then press-formed with a die and rapidly cooled.

EXAMPLES

As a steel sheet to be subjected to plating, a cold-rolled steel sheet (0.2% C-2.0% Si-2.3% Mn) having a sheet thickness of 1.6 mm was prepared.

After cutting this steel sheet into 100 mm×200 mm, annealing and hot-dip plating were continuously performed using a batch-type hot-dip plating tester.

During the annealing, the annealing was performed at 860° C. for 120 seconds in an atmosphere containing 5% of $H_2$ gas and a remainder consisting of $N_2$ and having a dew point of 0° C. in a furnace having an oxygen concentration of 20 ppm or less.

After the annealing, the steel sheet was subjected to air cooling with $N_2$ gas, and when a temperature of the steel sheet reached a bath temperature+20° C., the steel sheet was immersed in a plating bath having the bath temperature shown in Table 1 for about 3 seconds.

A plated base sheet on which a plating layer was formed was cooled under the conditions shown in Table 1 after adjusting a plating adhesion amount to 40 to 80 g/m$^2$ with $N_2$ gas. Thereafter, reheating was performed as necessary, and holding was performed under the conditions shown in Table 1. The temperature of the steel sheet was measured using a thermocouple spot-welded to a central part of the plated base sheet.

In addition, for the obtained plated steel, the plated steel was inserted into a muffle furnace in an air atmosphere set to 900° C., was taken out after 4 minutes had passed, and was subjected to hot stamping in which pressing with a flat sheet die and rapid cooling were performed, thereby obtaining a hot stamped member.

In the obtained hot stamped member, by the above-described methods, a chemical composition of the plating layer, whether or not a Zn-based oxide (Zn oxide and/or Zn—Mg oxide) having a size of 1.0 μm or more and 10.0 μm or less in a thickness direction of the plating layer and 0.1 μm or more in a direction (surface direction) perpendicular to the thickness direction was included, and in a case where the Zn-based oxide was included, ratios ΣLi/Le and ΣLai/ΣLi of projected lengths of the Zn-based oxide to an interface with the steel were examined. The results are shown in Tables 1 and 2.

In addition, spot welding was performed on these hot stamped members under the following conditions, a cross section of a welded part was observed, and length of a crack (LME crack) was evaluated.

That is, samples of 50 mm×50 mm (× sheet thickness) were collected from hot stamped members Nos. 1 to 26 shown in the table, and were overlapped on a commercially available hot-dip galvannealed steel sheet having the same size, and were subjected to spot welding by pressing an energizing electrode to cause a hitting angle to be 7° (a difference between a direction perpendicular to the surface of the steel sheet and an axial direction of the electrode) and a load to be 400 kgf and setting a current pattern to cause a nugget diameter to be 3.5×√t to 5.5×√t (t: sheet thickness). A DR6φ type Cu—Cr electrode according to the JIS standard was used as the energizing electrode.

After the spot welding, the steel sheet was cut in parallel to the direction in which the hitting angle was provided so that a sheet thickness direction cross section in a sheet thickness direction of the steel sheet could be observed. After the cutting, the cross section of the welded part mirror-polished and finished by mechanical polishing and chemical polishing was observed with an optical microscope, and an LME crack length of an internal crack was measured.

Determination was made as follows depending on the presence or absence and a length of a crack, and excellent LME resistance was determined in a case of AA or A.

(Evaluation)

AA: No crack

A: Crack length 100 μm or less

B: Crack length more than 100 μm

In addition, a sample of 50 mm×100 mm (× sheet thickness) was collected from the hot stamped member, and this sample was subjected to a zinc phosphate treatment according to (SD5350 system: a standard manufactured by Nipponpaint Industrial Coatings Co., LTD.) to form a chemical conversion film.

By observing the surface of the plated steel sheet on which the chemical conversion film was formed by SEM, a ratio (area %) of lack of hiding of the chemical conversion film was measured.

Determination was made as follows according to the ratio of lack of hiding, and it was determined that chemical convertibility was excellent in a case of AA or A.

AA: 5% or less

A: More than 5% and 10% or less

B: More than 10%

In addition, corrosion resistance (corrosion resistance after coating) of the obtained hot stamped member was evaluated.

That is, a sample of 50×100 mm was collected from the hot stamped member, was subjected to a Zn phosphate treatment (SD5350 system: a standard manufactured by Nipponpaint Industrial Coatings Co., LTD.), was thereafter subjected to electrodeposition coating (PN110 POWERNIX (registered trademark) gray: a standard manufactured by Nipponpaint Industrial Coatings Co., LTD.) to a thickness of 20 μm, and was subjected to baking at a baking temperature of 150° C. for 20 minutes. Thereafter, a cut reaching the base metal was introduced into an electrodeposition coating film and was subjected to a JASO test. In the JASO test, a case where a swelling width of the coating film at 90 cycles was 1 mm or less was evaluated as "A", and a case of more than 1 mm was evaluated as "B".

In addition, as spot weldability of the obtained hot stamped member, an appropriate current range during the spot welding was evaluated.

That is, a sample of 50 mm×50 mm (× sheet thickness) was collected from a flat portion of the hot stamped member, plated surfaces of the two samples were overlapped and pressed in close contact with each other so that a welding pressure between electrodes became 200 kgf. In this state, spot welding was performed while changing a welding current in increments of 0.5 kA from 4 to 12 kA. A single-phase AC (50 Hz) power source was used, and an energization time was set to 12 cycles. A resister welder manufactured by DENGENSHA was used as a spot welder, and a dome radius type Cr—Cu electrode (tip diameter φ6 mm) was used as the electrode. After the spot welding, a nugget diameter was measured by observing a cross section of a welded part with an optical microscope, and the relationship between the welding current and the nugget diameter (weld lobe) was examined.

Furthermore, using a current value (nugget formation current) at which the nugget diameter became 4√t or higher as a lower limit and a current value (expulsion generation current) at which expulsion was generated as an upper limit, an appropriate current range (unit: kA) was measured.

The following evaluation was performed according to a width of the appropriate current range.

AA: 2 kA or higher

A: 1 to lower than 2 kA

B: Lower than 1 kA

TABLE 1

| Manufacturing steps | | |
|---|---|---|
| Cooling step | | |
| Average cooling rate between | Average cooling rate | Time |

TABLE 1-continued

| Classification | No. | Plating step Bath temperature (° C.) | bath temperature and 380° C. (° C./s) | between 380° C. and 200° C. (° C./s) | Cooling stop temperature (° C.) | until holding step (min) | Holding step Holding temperature (° C.) | Holding step Retention time (s) |
|---|---|---|---|---|---|---|---|---|
| Comparative Example | 1 | 700 | 20 | 80 | 70 | <1 | 100 | 500 |
| Example | 2 | 700 | 20 | 80 | 70 | <1 | 100 | 500 |
| Example | 3 | 700 | 20 | 80 | 70 | <1 | 100 | 500 |
| Example | 4 | 690 | 20 | 80 | 70 | <1 | 100 | 500 |
| Example | 5 | 690 | 20 | 80 | 70 | <1 | 100 | 500 |
| Example | 6 | 670 | 20 | 80 | 70 | <1 | 100 | 500 |
| Example | 7 | 670 | 20 | 80 | 70 | <1 | 100 | 500 |
| Comparative Example | 8 | 670 | 20 | 80 | 70 | <1 | — | — |
| Example | 9 | 670 | 20 | 40 | 70 | <1 | 100 | 500 |
| Example | 10 | 680 | 20 | 80 | 70 | <1 | 100 | 500 |
| Example | 11 | 660 | 20 | 80 | 70 | <1 | 100 | 500 |
| Example | 12 | 660 | 20 | 80 | 70 | <1 | 100 | 500 |
| Example | 13 | 660 | 20 | 80 | 70 | 5 | 100 | 500 |
| Example | 14 | 660 | 20 | 80 | 70 | <1 | 100 | 500 |
| Example | 15 | 660 | 20 | 80 | 70 | <1 | 150 | 300 |
| Example | 16 | 660 | 20 | 80 | 70 | <1 | 150 | 300 |
| Example | 17 | 660 | 20 | 80 | 70 | <1 | 150 | 300 |
| Example | 18 | 650 | 20 | 80 | 70 | <1 | 200 | 100 |
| Example | 19 | 630 | 20 | 80 | 70 | <1 | 100 | 500 |
| Comparative Example | 20 | 670 | 20 | 80 | 70 | <1 | 100 | 500 |
| Comparative Example | 21 | 680 | 20 | 80 | 205 | <1 | 200 | 500 |
| Comparative Example | 22 | 680 | 20 | 80 | 20 | <1 | 20 | 500 |
| Comparative Example | 23 | 680 | 20 | 80 | 70 | <1 | 290 | 500 |
| Comparative Example | 24 | 680 | 20 | 80 | 70 | <1 | 100 | 10 |
| Comparative Example | 25 | 680 | 20 | 20 | 70 | <1 | 100 | 100 |
| Comparative Example | 26 | 680 | 20 | 80 | 70 | 8 | 100 | 100 |

| Classification | Hot stamped member Chemical composition of plating layer, remainder Al and impurities Zn (mass %) | Mg (mass %) | Si (mass %) | Fe (mass %) | Others Kind | Others (mass %) |
|---|---|---|---|---|---|---|
| Comparative Example | 0.0 | 1.0 | 8.0 | 40.0 | — | 0 |
| Example | 0.5 | 0.2 | 1.5 | 60.0 | Sb | 0.005 |
| Example | 0.5 | 5.0 | 4.0 | 56.0 | Sn | 0.06 |
| Example | 1.0 | 7.0 | 8.0 | 20.0 | — | 0 |
| Example | 5.0 | 1.0 | 4.0 | 54.0 | Cr | 0.0004 |
| Example | 5.0 | 1.5 | 4.0 | 50.0 | Mn | 0.0002 |
| Example | 5.0 | 3.0 | 4.0 | 40.0 | Pb | 0.003 |
| Comparative Example | 5.0 | 0.4 | 8.0 | 30.0 | — | 0 |
| Example | 7.0 | 0.7 | 4.0 | 37.0 | — | 0 |
| Example | 7.0 | 3.0 | 4.0 | 33.0 | Ti | 0.0005 |
| Example | 7.0 | 3.0 | 4.0 | 33.0 | — | 0 |
| Example | 9.0 | 2.0 | 4.0 | 41.0 | Ni | 0.1 |
| Example | 9.0 | 2.0 | 4.0 | 41.0 | Cu | 0.0005 |
| Example | 9.0 | 2.0 | 4.0 | 41.0 | Zr | 0.02 |
| Example | 10.0 | 1.0 | 4.0 | 42.0 | Hf | 0.001 |
| Example | 10.0 | 1.0 | 4.0 | 42.0 | Sr | 0.002 |
| Example | 10.0 | 1.4 | 1.0 | 40.0 | Ca | 0.004 |
| Example | 13.0 | 1.5 | 5.0 | 39.0 | Ce: 0.0001, La: 0.0001 | 0.0002 |
| Example | 15.0 | 1.5 | 5.0 | 39.0 | — | 0 |
| Comparative Example | 18.0 | 2.0 | 7.0 | 31.0 | — | 0 |
| Comparative Example | 9.0 | 0.5 | 8.0 | 37.0 | — | 0 |
| Comparative Example | 9.0 | 1.5 | 8.0 | 36.0 | — | 0 |
| Comparative Example | 9.0 | 1.5 | 8.0 | 38.0 | — | 0 |

TABLE 1-continued

| | | | | | | |
|---|---|---|---|---|---|---|
| Comparative Example | 9.0 | 1.0 | 8.0 | 37.0 | — | 0 |
| Comparative Example | 9.0 | 1.0 | 8.0 | 37.0 | — | 0 |
| Comparative Example | 15.0 | 1.5 | 3.0 | 46.0 | — | 0 |

TABLE 2

| | Hot stamped member | | | | | |
|---|---|---|---|---|---|---|
| | | Microstructure of plating layer | | | | |
| No. | Thickness of plating layer (μm) | Presence or absence of Zn oxide or Zn—Mg oxide of 0.1 μm or more in surface direction and 1 to 10 μm in thickness direction | Ratio of projected lengths of Zn oxide or Zn—Mg oxide ΣLi/Le | Ratio of projected lengths of Zn oxide or Zn—Mg oxide in close contact with plating layer ΣLai/ΣLi | Amount of solute Zn in $Fe_2Al_5$ phase (mass %) | Mg-based IMC phase (area %) |
| 1 | 23 | Absent | — | — | 6.10 | 0 |
| 2 | 25 | Present | 0.10 | 0.50 | 3.10 | 0 |
| 3 | 24 | Present | 0.35 | 0.60 | 3.00 | 0 |
| 4 | 25 | Present | 0.45 | 0.80 | 3.40 | 6 |
| 5 | 25 | Present | 0.67 | 0.80 | 6.10 | 0 |
| 6 | 26 | Present | 0.77 | 0.87 | 5.60 | 0 |
| 7 | 22 | Present | 0.77 | 0.95 | 4.10 | 3 |
| 8 | 21 | Present | 0.05 | 0.43 | 5.10 | 10 |
| 9 | 31 | Present | 0.86 | 0.89 | 6.10 | 0 |
| 10 | 26 | Present | 0.83 | 0.89 | 6.60 | 2 |
| 11 | 28 | Present | 0.79 | 0.98 | 5.10 | 0 |
| 12 | 45 | Present | 0.81 | 0.80 | 6.60 | 0 |
| 13 | 50 | Present | 0.79 | 0.77 | 5.60 | 2 |
| 14 | 25 | Present | 0.89 | 0.89 | 6.10 | 1 |
| 15 | 25 | Present | 0.82 | 0.84 | 7.00 | 0 |
| 16 | 41 | Present | 0.98 | 0.85 | 7.50 | 0 |
| 17 | 25 | Present | 0.99 | 0.95 | 7.20 | 10 |
| 18 | 27 | Present | 0.89 | 0.90 | 7.60 | 0 |
| 19 | 37 | Present | 1.00 | 1.00 | 8.00 | 2 |
| 20 | 21 | Present | 1.00 | 0.41 | 1.20 | 13 |
| 21 | 25 | Present | 0.05 | 1.00 | 2.10 | 0 |
| 22 | 25 | Present | 0.04 | 1.00 | 2.20 | 0 |
| 23 | 22 | Present | 0.05 | 1.00 | 2.50 | 0 |
| 24 | 21 | Present | 0.05 | 1.00 | 2.40 | 0 |
| 25 | 25 | Present | 0.06 | 1.00 | 2.10 | 0 |
| 26 | 22 | Present | 0.11 | 0.46 | 6.10 | 0 |

TABLE 3

| | Hot stamped member | | | |
|---|---|---|---|---|
| No. | LME resistance | Chemical convertibility | Corrosion resistance | Appropriate current range |
| 1 | AA | B | A | B |
| 2 | AA | A | A | A |
| 3 | AA | AA | A | AA |
| 4 | A | AA | A | AA |
| 5 | AA | AA | A | AA |
| 6 | AA | AA | A | AA |
| 7 | AA | AA | A | AA |
| 8 | B | B | A | B |
| 9 | AA | A | A | AA |
| 10 | AA | AA | A | AA |
| 11 | AA | AA | A | AA |
| 12 | AA | AA | A | AA |
| 13 | AA | AA | A | AA |
| 14 | AA | AA | A | AA |
| 15 | A | AA | A | AA |
| 16 | A | AA | A | AA |
| 17 | A | AA | A | AA |
| 18 | A | AA | A | AA |

TABLE 3-continued

| | Hot stamped member | | | |
|---|---|---|---|---|
| No. | LME resistance | Chemical convertibility | Corrosion resistance | Appropriate current range |
| 19 | A | AA | A | AA |
| 20 | B | AA | B | B |
| 21 | AA | B | B | A |
| 22 | AA | B | B | A |
| 23 | AA | B | B | A |
| 24 | AA | B | B | A |
| 25 | AA | B | B | A |
| 26 | AA | B | A | B |

As can be seen from Tables 1 to 3, in Nos. 2 to 7 and Nos. 9 to 19 in which a predetermined chemical composition is provided, the plating layer contained a Zn-based oxide including one or two of a Zn oxide and a Zn—Mg oxide having a size of 1.0 μm or more and 10.0 μm or less in the thickness direction of the plating layer and 0.1 μm or more in the direction perpendicular to the thickness direction, and ΣLi/Le≥0.10 and ΣLai/ΣLi≥0.50 were satisfied, chemical convertibility or LME resistance during spot welding was excellent. Contrary to this, in Comparative Example Nos. 1, 8, and 20 to 26 in which one or more of the chemical composition of the plating layer and the presence state of the Zn-based oxide were outside of the range of the present invention, chemical convertibility or LME resistance during spot welding was inferior.

In addition, among the invention examples, in Nos. 2 to 19, since the amount of solute Zn in the $Fe_2Al_5$ phase was in a preferable range of 3.00 mass % or more, corrosion resistance was also excellent.

In addition, in Nos. 3 to 19, since the ratio ΣLai/ΣLi of the projected lengths of the Zn oxide or Zn—Mg oxide in close contact with the plating layer was in a preferable range of 0.60 or more, the appropriate current range was also wide.

BRIEF DESCRIPTION OF THE REFERENCE SYMBOLS

1: steel
2: plating layer
101: Zn-based oxide

What is claimed is:

1. A hot stamped member comprising:

a steel; and a plating layer formed on the steel, wherein the plating layer contains, as a chemical composition, by mass %, Zn: 0.5% to 15.0%,
Mg: 0% to 10.0%,
Si: 0.05% to 10.0%,
Fe: 20.0% to 60.0%,
0% to 5.00% in total of one or two or more selected from
Ca: 0% to 3.00%,
Sb: 0% to 0.50%,
Pb: 0% to 0.50%,
Sr: 0% to 0.50%,
Sn: 0% to 1.00%,
Cu: 0% to 1.00%,
Ti: 0% to 1.00%,
Ni: 0% to 1.00%,
Mn: 0% to 1.00%,
Cr: 0% to 1.00%,
La: 0% to 1.00%,
Ce: 0% to 1.00%,
Zr: 0% to 1.00%, and
Hf: 0% to 1.00%, and
a remainder of Al and impurities, the plating layer contains a Zn-based oxide including one or two of a Zn oxide and a Zn—Mg oxide having a size of 1.0 μm or more and 10.0 μm or less in a thickness direction of the plating layer and 0.1 μm or more in a direction perpendicular to the thickness direction, and in a cross section of the plating layer in the thickness direction, when a length of an interface between the plating layer and the steel is indicated as Le, a sum of lengths of the Zn-based oxide projected onto the interface from an upper surface of the plating layer is indicated as ΣLi, and a sum of lengths of portions of the Zn-based oxide in contact with the plating layer projected onto the interface from the upper surface of the plating layer is indicated as ΣLai, Expressions (1) and (2) are satisfied, $$\Sigma Li/Le \geq 0.10 \quad (1)$$

$$\Sigma Lai/\Sigma Li \geq 0.50 \quad (2).$$

2. The hot stamped member according to claim 1, wherein, in the chemical composition, by mass %, Mg: 0.2% to 7.0% is satisfied.

3. The hot stamped member according to claim 1, wherein, in the chemical composition, by mass %,
Mg: 3.0% to 7.0%, and
Zn: 7.0% to 15.0%
are satisfied.

* * * * *